US009809910B2

(12) United States Patent
De Keyzer et al.

(10) Patent No.: US 9,809,910 B2
(45) Date of Patent: Nov. 7, 2017

(54) HEAT RESISTANT SEPARATION FABRIC

(71) Applicant: NV BEKAERT SA, Zwevegem (BE)

(72) Inventors: Daan De Keyzer, Deerlijk (BE); Filip Lanckmans, Lennik (BE); Frank De Ridder, Hofstade-Aalst (BE)

(73) Assignee: NV BEKAERT SA, Zwevegem (BE)

( * ) Notice: Subject to any disclaimer, the term of this patent is extended or adjusted under 35 U.S.C. 154(b) by 390 days.

(21) Appl. No.: 14/396,296

(22) PCT Filed: May 15, 2013

(86) PCT No.: PCT/EP2013/060069
§ 371 (c)(1),
(2) Date: Oct. 22, 2014

(87) PCT Pub. No.: WO2013/174698
PCT Pub. Date: Nov. 28, 2013

(65) Prior Publication Data

US 2015/0075228 A1 Mar. 19, 2015

(30) Foreign Application Priority Data

May 23, 2012 (EP) ..... 12169113

(51) Int. Cl.
*D04B 21/16* (2006.01)
*D04B 21/20* (2006.01)

(52) U.S. Cl.
CPC ..... *D04B 21/16* (2013.01); *D04B 21/20* (2013.01)

(58) Field of Classification Search
CPC ..... D04B 21/16; D04B 21/20
See application file for complete search history.

(56) References Cited

U.S. PATENT DOCUMENTS

| | | | | |
|---|---|---|---|---|
| 2,050,298 A | | 8/1936 | Everett | |
| 2,249,650 A | * | 7/1941 | Foster | D04B 21/16 66/193 |
| 3,277,564 A | | 10/1966 | Webber et al. | |
| 3,394,213 A | | 7/1968 | Roberts et al. | |
| 3,472,289 A | * | 10/1969 | Riordan | B64D 15/12 139/391 |
| 3,806,959 A | * | 4/1974 | Gross | D04B 21/16 297/DIG. 5 |
| 4,181,514 A | * | 1/1980 | Lefkowitz | B01D 39/20 210/504 |

(Continued)

FOREIGN PATENT DOCUMENTS

| | | | |
|---|---|---|---|
| AU | 2003212039 | A1 | 8/2003 |
| EP | 0972751 | A2 | 1/2000 |

(Continued)

OTHER PUBLICATIONS

International Search Report (ISR) dated Oct. 11, 2013, for PCT/EP2013/060069.

*Primary Examiner* — Danny Worrell
(74) *Attorney, Agent, or Firm* — Bacon & Thomas, PLLC

(57) ABSTRACT

A warp knitted heat resistant separation fabric is provided, having at least two sets of warp yarns. A first set of warp yarns is positioned over the width of the fabric and formed with pillar stitches; and a second set of warp yarns positioned over the width of the fabric shows in its repeat in the fabric an underlap under at least two pillars that are formed by the first set of warp yarns.

14 Claims, 1 Drawing Sheet

(56) References Cited

U.S. PATENT DOCUMENTS

| | | | | |
|---|---|---|---|---|
| 4,433,493 | A * | 2/1984 | Poisson | D04B 21/10 26/18.5 |
| 4,930,199 | A | 6/1990 | Yanagisawa | |
| 5,230,226 | A * | 7/1993 | Saarikettu | D04B 1/00 210/499 |
| 5,386,646 | A * | 2/1995 | Saarikettu | B01D 39/083 34/582 |
| 6,699,802 | B1 * | 3/2004 | Hainsworth | A41D 31/0022 428/920 |
| 6,745,599 | B2 * | 6/2004 | Bailey | D04B 21/00 442/305 |
| 6,840,066 | B2 * | 1/2005 | Dickerson | D04B 21/18 66/192 |
| 7,681,417 | B2 * | 3/2010 | Hagihara | A41D 19/01529 2/161.6 |
| 2002/0115369 | A1 | 8/2002 | Yokoyama et al. | |
| 2011/0023206 | A1 * | 2/2011 | Dunn | A41D 31/0022 2/81 |

FOREIGN PATENT DOCUMENTS

| | | | |
|---|---|---|---|
| JP | S51-017163 | A | 2/1976 |
| JP | S61-137623 | A | 6/1986 |
| JP | S62-259612 | A | 11/1987 |
| WO | 00/40792 | A1 | 7/2000 |

* cited by examiner

HEAT RESISTANT SEPARATION FABRIC

BACKGROUND OF THE INVENTION

Technical Field

The invention relates to the field of heat resistant separation fabrics. The invention describes knitted heat resistant separation fabrics that are produced via warp knitting and that provide improved properties. The warp knitted heat resistant separation fabrics of the invention can be used advantageously in the production of glass products, e.g. as mould covering in the bending of car glass. The invention further relates to methods to produce such warp knitted heat separation fabrics.

Background Art

US2002/0115369 discloses a stretch fabric that has an elongation of at least 20 percent in the warp direction. The stretch fabric is provided with both of the stretchability and the stiffness and is composed of a Raschel warp knit fabric formed of non-stretchable fiber yarns having no rubbery elasticity, wherein loops of tuck warp are engaged with loops of a ground fabric structure. The stretch knit fabric is suitably used as a medical material for covering or bandaging a human body having curved or irregular portions, as a reinforcement material for a moulded object having curved or irregular figure or portions, as a stretchable bandage, as a casting tape or as a splint for orthopedic surgery use.

The use of knitted fabrics, e.g. comprising stainless steel fibers, as heat resistant separation covering layer on tooling (moulds, rings, rollers) in car glass manufacturing is known e.g. from WO00/40792A1.

AU2003212039 discloses a covering material, resistant to high temperatures and intended to be inserted between tools and plates of hot glass during glass heating, bending or tempering processes. The covering material comprises a textile fabric comprising poly(p-phenylene-2,6-benzobisoxazole) fibers. The fabric can be a woven fabric, a braided fabric, a weft knitted fabric or a warp knitted fabric. The latter can be foreseen with polygonal openings, such warp knitted fabric can be used on cover rings, which support a glass plate during tempering operations.

EP0972751 describes a covering which is resistant to high temperature and intended to be inserted between tools and plates of hot glass. The covering includes a warp knitted fabric. The knitted fabric is provided with openings of polygonal shape, obtained by the mutual transfer of stitches from one wale to the other.

Heat resistant separation fabrics used for mould coverings in car glass manufacturing need to answer a number of requirements. They need to be extensible in order to be able to be mounted on the mould. State of the art knitted fabrics can be draped on the bending mould, but a risk exists that the fabric is not draped correctly, e.g. caused by overstretching in a particular direction of the fabric, resulting in quality problems when using the mould. The fabrics need to have sufficient air permeability as well and a high lifetime.

Most important however, is the quality of the car glass that is manufactured. Especially the optical quality of the car glass is essential. No defects are allowed in the car glass and the quality of the car glass has to be high over a long lifetime of the heat resistant separation fabric. Examples of defects that can occur are so-called orange peel and pitting. Besides defects in the car glass due to yarn defects or knitting defects in the fabric, defects in the glass can be related to the fabric construction or composition, to the mounting of the fabric on the mould, to—e.g. local—insufficient air permeability as well as due to ageing of the fabric. It is generally accepted that complex interactions play between the factors that can cause such defects in the car glass.

SUMMARY OF THE INVENTION

The primary objective of the invention is to provide a heat resistant separation fabric that has improved properties.

The objective is achieved by the first aspect of the invention in which a warp knitted heat resistant separation fabric is provided, e.g. for use in the production of glass products, e.g. car glass products. The fabric comprises at least two sets of warp yarns:

- a first set of warp yarns positioned over the width of the fabric is forming pillar stitches, preferably along the full length of the fabric; and
- a second set of warp yarns positioned over the width of the fabric shows in its repeat in the fabric an underlap under at least two pillars formed by the first set of warp yarns. In a preferred embodiment, this repeat of the second set of warp yarns comprises zero stitches (=no loops formed in the second set of warp yarns by the knitting needles). In another preferred embodiment, this repeat comprises two stitches (=two loops in the second set of warp yarns formed by the knitting needles). The underlap can e.g. be formed under two, three, four or five pillars, but the underlap can also be formed under a higher number of pillars. Where the repeat of the second set of warp yarns comprises zero stitches, the underlap of the second set of warp yarns is forming an inlay in the fabric, as such inlay is formed by making an underlap during knitting.

In order to clarify what is meant with an underlap under two pillars of the second set of warp yarns, the following two examples are given. In both cases the first set of warp yarns and of the second set of warp yarns are fully threaded in their guide bars:

First example: the first set of warp yarns makes a closed pillar stitch with lapping pattern 0-1/0-1// and the second set of warp yarns makes a cord stitch with lapping pattern 1-0/2-3//. The underlap of the second set of warp yarns is 0/2 (and than also 3//1), under two pillar stitches of the first set of warp yarns.

Second example: the first set of warp yarns makes a closed pillar stitch with lapping pattern 0-1/0-1// and the second set of warp yarns makes an inlay with lapping pattern 0-0/2-2//. The underlap of the second set of warp yarns is 0/2 (and than also 2//0), under two pillar stitches of the first set of warp yarns.

Warp knitting is defined as a loop-forming process in which the yarn is fed into the knitting zone, parallel to the fabric selvedge and a fabric formed this way is a warp knitted fabric. Such warp knitted fabrics can be produced on a number of different machine types, including warp knitting machines, raschel knitting machines and crochet machines.

The fabric of the invention has shown to be better suited than prior art fabrics for use as cover for the bending mould in car glass manufacturing. The combination of structural features of the fabric leads to a fabric that results in improved quality of car glass as the use of the fabric results in less defects in the car glass, due to the interactive combination of the easier correct draping of the fabric on the mould, sufficiently high air permeability which remains sufficiently uniform after draping and the appropriate fabric surface structure for contact with the hot glass.

Surprisingly fabrics according to the invention resulted in good performance, although such fabrics are thicker than the prior art weft knitted fabrics. If is known for weft knitted heat resistant separation fabrics that a thicker fabric results in lower air permeability, which is negative for the application. But surprisingly the warp knitted fabric according to the invention shows suitable air permeability.

Although open and closed pillar stitches can be used in the invention, open pillar stitch is preferred as it increases the reliability of correct draping of the fabric on a mould, and results in better quality of the car glass.

Preferably, except for the one or more sets of warp yarns that are forming pillar stitches, the fabric does not contain warp yarn sets with an underlap under less than two pillars. Such fabrics provide better results.

Preferably the fabric does not contain tuck warp yarns. A tuck warp yarn builds a loop formed of a warp yarn separate from that forming a loop of the ground fabric structure, which tuck warp is additionally transferred to the back side of the stitches to be additionally engaged with the back side of the loops of the ground fabric structure so that it does not cause any restraint on the lap of the ground fabric.

In a first group of specific embodiments the second set of warp yarns comprises in its repeat an arrangement of two consecutive stitches (=loops formed by the knitting actions by the needles) that are knitted in consecutive courses and in wales that are at least two wales away from each other, preferably the repeat comprises two stitches (or loops) in its repeat pattern. Preferably, the loops formed by the second set of warp yarns are closed loops as such fabrics can be knitted more easily with the yarns suited for use in the heat resistant separation fabrics.

This embodiment results in an excellent ability to drape the fabric correctly onto the mould.

Examples of such first group of specific embodiments are where the two consecutive stitches are knitted in consecutive courses that are in wales that are two, three, four, five, six, seven or eight wales away from each other. Preferred is at least three wales away, more preferred is at least five wales away. A higher number of wales away, and preferably lower than nine, results in best interactive combination of the easier correct draping of the fabric on the mould, sufficiently high air permeability which remains sufficiently uniform after draping and the appropriate fabric surface structure for contact with the hot glass.

In a specific embodiment of the first group, the second set of yarns is forming a cord stitch. A cord stitch is known in knitting as a repeat pattern of knitted stitches (loops) that are knitted in consecutive courses and in wales that are two wales away from each other. Example of such a lapping pattern is 1-0/2-3//.

In another specific embodiment of the first group, the second set of yarns is forming a satin stich. A satin stitch is known in knitting as a repeat pattern of knitted stitches (loops) that are knitted in consecutive courses and in wales that are three wales away from each other. Example of such a lapping pattern is 1-0/3-4//.

In yet another specific embodiment of the first group, the second set of yarns is forming a velvet stich. A velvet stitch is known in warp knitting as a repeat pattern of knitted stitches (loops) that are knitted in consecutive courses and in wales that are four wales away from each other. Example of such a lapping pattern is 1-0/4-5//.

In other specific embodiments of the first group, the second set of yarns forms a stich defined as repeat pattern of knitted stitches (loops) that are knitted in consecutive courses and in wales that are e.g. five, or e.g. six, or e.g. seven or e.g. eight wales away from each other.

It is a benefit of the embodiments of the first group that a still better optical quality of the car glass fabric can be obtained, also compared to the embodiments of the second group.

In a second group of specific embodiments the underlap of the second set of warp yarns is created by an inlay. With inlay is meant that the yarns are not building stitches (or loops), but are laid as an underlap in between overlaps and underlaps of other yarns that are building stitches, e.g. between overlaps and underlaps of the first set of warp yarns that are building pillar stiches.

Compared to the embodiments of the first group in which the second set of warp yarns is building stiches, the embodiments of the second group result in fabrics which are easier to drape correctly over a mould.

Preferred is inlay under 2 to 8 pillars, more preferred under 4 to 8 pillars, e.g. under 4 pillars. The latter range is particularly beneficial for the ability to mount the fabric correctly onto the mould.

In a preferred embodiment of the second group of embodiments, the second set of warp yarns comprises ceramic yarns.

In another such embodiment, the second set of warp yarns comprises an austenitic nickel-chromium based super alloy, such as alloys comprising more than 12% by weight of chromium and more than 40% by weight of nickel (e.g. Inconel alloys, e.g. Inconel 601).

In another such embodiment of the second group of embodiments, the second set of yarns comprises a super alloy with chromium, nickel and molybdenum, preferably with at least 10% by weight of molybdenum; e.g. an alloy comprising more than 20% by weight of chromium and more than 10% by weight of molybdenum (e.g. Hastelloy).

Such embodiments provide heat resistant separation fabrics with higher lifetime.

Preferably, warp knitted heat resistant separation fabrics according to the invention are produced on knitting machines with a gauge finer than or equal to 8, e.g. 8, 10, 12, 14, 16, 18 or 20. With gauge is meant the number of knitting needles per inch of the knitting machine. Gauge 8 means that 8 knitting needles are positioned per inch width of the knitting machine.

Gauge 12 is a preferred gauge because it avoids that finer yarns are required.

Preferably, the first set of warp yarns is fully threaded in its guide bar and/or the second set of warp yarns is fully threaded in its guide bar.

Preferably, the number of courses per centimeter in the fabric according to the invention is higher than 3 per cm. A preferred range for the number of courses per centimeter is 3 to 6, even more preferred is between 3.5 to 5.5, and still even more preferred is between 4.5 to 5.5 courses per cm. A high number of courses per centimeter is preferred, as such fabrics result in a heat resistant separation fabric that can be more reliably draped on a mould, resulting in better and more stable performance in use.

Preferably, the number of wales per centimeter in the fabric according to the invention is higher than 3 per cm. Even more preferred is higher than 4 per cm, and even more preferred is higher than 5 per cm. A higher number of wales per centimeter is preferred, as such fabrics result in a heat resistant separation fabric that can be more reliably draped on a mould, resulting in better and more stable performance in use.

The warp knitted heat resistant separation fabrics of the invention preferably have a single needle bed structure. A single needle bed structure is obtained by using only one needle bed to make stitches. Fabrics according to the invention can be fabrics in which two needle beds are used (and which consequently have a double needle bed structures), however, fabrics with single needle bed structure show the benefit that they are better able to withstand cyclic loading at high temperatures. This is important as the fabrics undergo cyclic loading at high temperatures when used as mould cover in the bending of car glass.

The warp knitted heat resistant separation fabrics of the invention can e.g. be made on single bed warp knitting machine or on a single bed raschel machine or on a single bed warp knitting crochet machine. Fabrics according to the invention can also be made on double bed machines (double bed raschel machines, double bed warp knitting machines, double bed warp knitting crochet machines) as well. When double bed machines are used, one or both needle beds can be used in knitting.

In preferred warp knitted heat resistant separation fabrics, the first set of warp yarns and/or the second set of warp yarns comprise stainless steel fibers.

In preferred warp knitted heat resistant fabrics, the first set of warp yarns and/or the second set of warp yarns comprise glass fibers.

In preferred warp knitted heat resistant fabrics, the first set of warp yarns and/or the second set of warp yarns comprise PBO-fibers.

The warp knitted fabric according to the invention comprises yarns. Examples of yarns that can be used for the first set of warp yarns and/or for the second set of warp yarns are spun yarns comprising or consisting out of stainless steel fibers. Preferred yarns comprising stainless steel yarns are spun from stretch broken bundle drawn stainless steel fibers. The yarns can consist of 100% stainless steel fibers, or can be a blended, comprising different types of fibers. An example of such a blended yarn that can be used is an intimate blend comprising stainless steel fibers and man-made non-metal fibers. Examples are yarns comprising stainless steel fibers and PBO—poly(p-phenylene-2,6-benzobisoxazole)—fibers or glass fibers or a combination thereof. PBO fibers have the advantage of giving an increased degree of softness to the fabric. A typical percentage lies between 20% and 40% stainless steel fibers by weight and thus between 80% and 60% by weight man-made fibers. A good combination is about 30% (by weight) stainless steel fibers and 70% (by weight) PBO fibers.

Preferably, the yarns that are used are multiply yarns, e.g. two ply yarns or three ply yarns, wherein the plies can be different or the same. The plies can be twisted together. Examples of plied yarns are yarns comprising one or more plies comprising stainless steel fibers and comprising at least one ply comprising glass fibers or PBO fibers.

Examples of yarns are 11/2 Nm, 14/2 Nm, 15/2 Nm or 20/2 Nm stainless steel yarns spun from e.g. 8 or 12 μm equivalent diameter stainless steel fibers. "Nm" is defined as the amount of length of yarn expressed in meter for a mass of yarn of 1 gram. Nm is related to "tex" in that the value for Nm is obtained by dividing 1000 by the tex-value of a yarn. Tex is the mass in gram of 1 kilometer length of the yarn. With 11/2 Nm is meant that two yarns of 11 Nm each are twisted together, the final yarn is 5.5 Nm, but as it is a twisted yarn with two plies, such yarn is generally indicated as 11/2 Nm.

Stainless steel fibers that can be used in the invention, e.g. with a diameter less than 40 micrometers, e.g. less than 25 micrometers, can be obtained by a bundle drawing technique. This technique is disclosed e.g. in U.S. Pat. No. 2,050,298, U.S. Pat. No. 3,277,564 and in U.S. Pat. No. 3,394,213. Metal wires are forming the starting material and are covered with a coating such as iron or copper. A bundle of these covered wires is subsequently enveloped in a metal pipe. Thereafter the thus enveloped pipe is reduced in diameter via subsequent wire drawing steps to come to a composite bundle with a smaller diameter. The subsequent wire drawing steps may or may not be alternated with an appropriate heat treatment to allow further drawing. Inside the composite bundle the initial wires have been transformed into thin fibers which are embedded separately in the matrix of the covering material. Such a bundle preferably comprises no more than 2000 fibers, e.g. between 500 and 1500 fibers. Once the desired final diameter has been obtained the covering material can be removed e.g. by dissolving it in an adequate pickling agent or solvent. The final result is the naked fiber bundle. The naked fiber bundle can then be spun into a yarn, e.g. after stretch breaking the fibers into fibers of discrete length.

Another manufacturing technique to make stainless steel fibers is machining. Machining of fibers is disclosed e.g. in U.S. Pat. No. 4,930,199. A strip of a thin metal plate is the starting material. This strip is wound around the cylindrical outer surface of a rotatably supported main shaft a number of times and is fixed thereto. The main shaft is rotated at constant speed in a direction opposite to that in which the plate material is wound. A cutter having an edge line expending perpendicularly to the axis of the main shaft is fed at constant speed. The cutter has a specific face angle parallel to the axis of the main shaft. The end surface of the plate material is cut by means of the cutter.

As an alternative to bundle drawing, metal fibers can also be made by starting from a hot rolled billet. This method is disclosed, amongst others, in U.S. Pat. No. 3,394,213, JP-A-51-017163, JP-A-62-259612 or JP-A-61-137623. This method is claimed to be less expensive than the technique of bundle drawing. Metal wire rods are packed together with a separating or barrier material, e.g. iron or very low carbon steel, in a tube or a brick and submitting this composite to a hot rolling operation possibly followed by a cold wire drawing operation. In difference with the technique of bundle drawing, the metal fibers obtained by starting from hot rolled composites, have a cross-section which differs to a greater extent from a circle. Moreover, there is a difference in cross-section between the fibers in the composite. The fibers at the outer side of the composite are radially more deformed to a more rectangular profile than are the fibers at the inner side of the composite. If the separating or barrier material is iron, the roughness of the fibers is also higher than in case copper is used as matrix.

According to a second aspect of the invention, a method is provided for the production of a warp knitted heat resistant fabric as in the first aspect of the invention, wherein a warp knitting machine or a raschel machine or a warp knitting crochet machine is used to knit the fabric.

Preferably, such machines are single needle bed machines or such machines are double needle bed machines on which only one needle bed is used for making stitches. Preferably the machines that are used are having a gauge finer than or equal to 8 needles per inch, e.g. 9, 10, 11, 12, 13, 14, 15, 16, 17, 18 needles per inch.

According to a third aspect of the invention the use of warp knitted heat separation fabrics as described in the first aspect of the invention is described in the manufacturing of glass, e.g. of car glass. A preferred use is as mould cover in glass manufacturing, e.g. of car glass, e.g. as mould cover on a male bending mould.

Preferably, the technical face of the warp knitted heat separation fabric is in contact with the glass. The technical face of the fabric is the side where the loop structure shows on the surface. The technical back of the fabric is the side where underlaps of stitch (=loop) forming warp yarns are shown on the surface.

The invention has to be understood in that elements and features of the different embodiments and/or of the different examples may and can be combined while still falling under the scope of the invention.

DETAILED DESCRIPTION THE INVENTION

Figure 1:
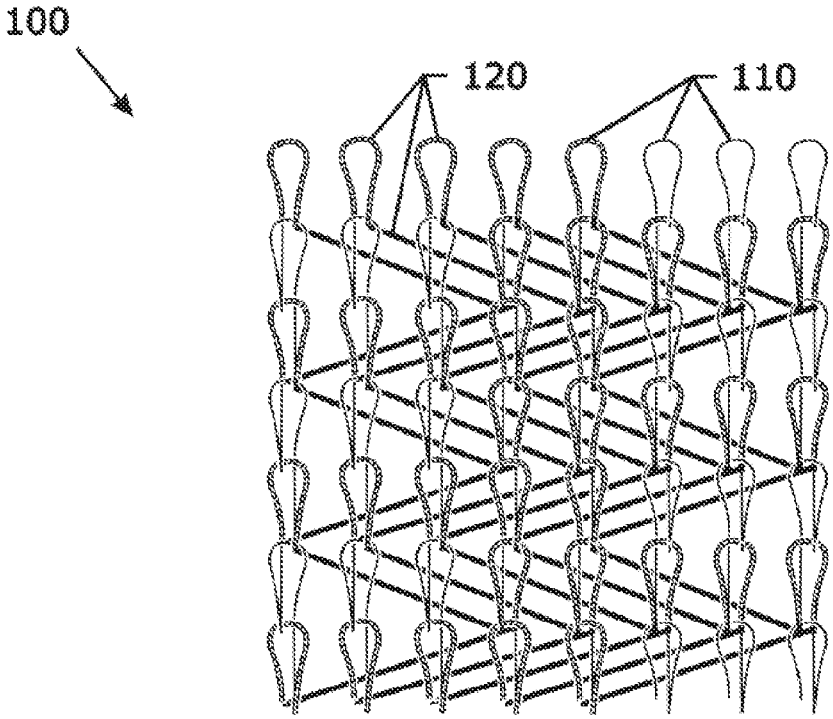
FIG. 1 shows a first example of a warp knitted heat resistant fabric according to the invention.

FIG. 1 shows an example of a warp knitted heat separation fabric 100 according to the invention. The fabric can be made on a single needle bed warp knitting machine and has a single needle bed structure. A first set of warp yarns 110 is fully threaded in its guide bar (which is the second guide bar on the knitting machine) and is forming an open pillar stich, with lapping pattern 0-1/1-0//. The second set of warp yarns 120 is fully threaded in its guide bar (which is the first guide bar on the knitting machine) and is forming a satin stich with lapping 1-0/3-4//, with an underlap (0/3) under three pillars.

Fabrics with such pattern have been made in gauge 8 and gauge 12. The fabric made on a machine with gauge 8 was knitted with Nm 11/2 stainless steel yarns for both sets of warp yarns, made from 12 μm equivalent diameter bundle drawn steel fibers of an alloy according to EN 1.4404. The fabric showed to have 3.5 wales per centimeter and 4.1 courses per centimeter. The fabric weight was 740.3 g/m$^2$. The air permeability (tested according to ISO 9237:1995; the test is performed at a pressure of 100 bar) was 1446 l/(dm$^2$*min). Fabric thickness, measured according to ISO 5084:1996, was 1.69 mm. Tensile testing was performed according to ISO 13934-1:1999. The tensile strength in wale direction was 216.24 N and the elongation at break in wale direction was 38.92%. The tensile strength in course direction was 250.39 N and the elongation at break in course direction was 60.82%.

The fabric made on a machine with gauge 12 was knitted with Nm 15/2 stainless steel yarns for both sets of warp yarns, made from 12 μm equivalent diameter bundle drawn steel fibers of an alloy according to EN 1.4404. The fabric showed to have 5.5 wales per centimeter and 4.2 courses per centimeter. The fabric weight was 734.5 g/m$^2$. The air permeability (tested according to ISO 9237:1995; the test is performed at a pressure of 100 bar) was 1138 l/(dm$^2$*min). Fabric thickness, measured according to ISO 5084:1996, was 1.95 mm. Tensile testing was performed according to ISO 13934-1:1999. The tensile strength in wale direction was 304.21 N and the elongation at break in wale direction was 31.21%. The tensile strength in course direction was 169.02 N and the elongation at break in course direction was 100.13%.

Figure 2:
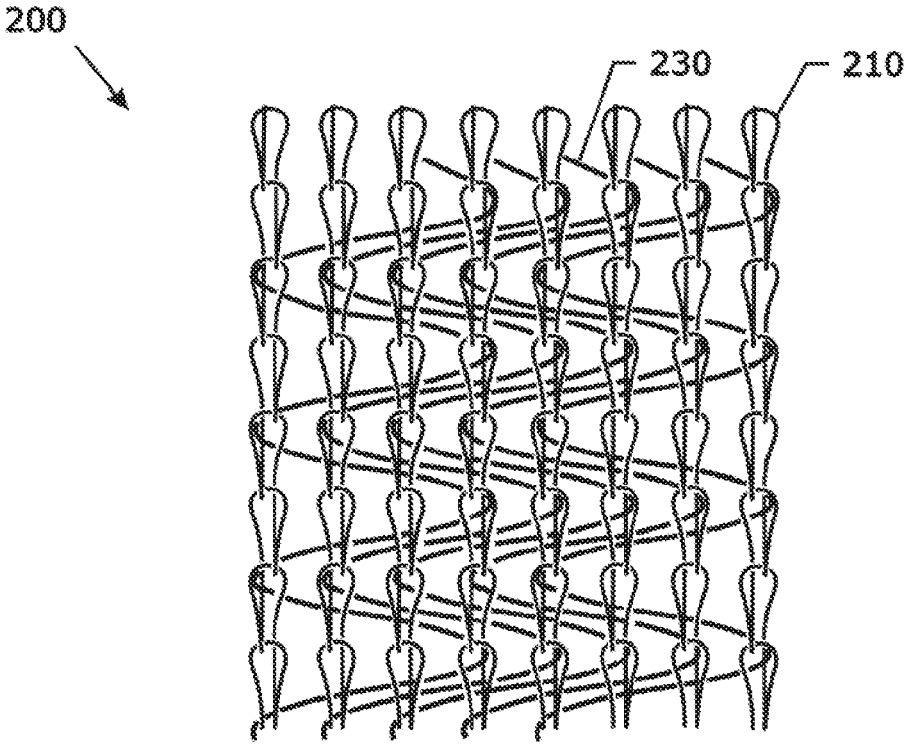
FIG. 2 shows a second example of a warp knitted heat resistant fabric according to the invention.

FIG. 2 shows another example of a warp knitted heat separation fabric 200 according to the invention. The fabric can be made on a single needle bed warp knitting machine and has a single needle bed structure. A first set of warp yarns 210 is fully threaded in its guide bar (which is the first or front guide bar on the knitting machine) and is forming an open pillar stich, with lapping pattern 1-0/0-1//. The second set of warp yarns 230 is fully threaded in its guide bar (which is the second guide bar on the knitting machine) and is forming an inlay with lapping 4-4/0-0//, with an underlap (4/0) under four pillars.

Two such fabrics have been made, with differing number of courses per centimeter. Both fabrics were made on a 12 gauge single bed knitting machine with in both sets of warp yarns a 15/2 Nm yarn spun from 12 μm equivalent diameter stainless steel fibers of alloy according to EN 1.4404. The first fabric had 4.3 wales per centimeter and 4.1 courses per centimeter. The fabric weight was 460.62 g/m$^2$. The air permeability (tested according to ISO 9237:1995; the test is performed at a pressure of 100 bar) was 1966 l/(dm$^2$*min). Fabric thickness, measured according to ISO 5084:1996, was 1.40 mm. Tensile testing was performed according to ISO 13934-1:1999. The tensile strength in wale direction was 211.21 N and the elongation at break in wale direction was 29.76%. The tensile strength in course direction was 135.51 N and the elongation at break in course direction was 74.89%.

The second fabric (with higher number of courses per cm) had 4.3 wales per centimeter and 5.1 courses per centimeter. The fabric weight was 532.55 g/m$^2$. The air permeability (tested according to ISO 9237:1995; the test is performed at a pressure of 100 bar) was 1750 l/(dm$^2$*min). Fabric thickness, measured according to ISO 5084:1996, was 1.18 mm. Tensile testing was performed according to ISO 13934-1:1999. The tensile strength in wale direction was 276.67 N and the elongation at break in wale direction was 24.24%. The tensile strength in course direction was 174.74 N and the elongation at break in course direction was 50.61%.

The invention claimed is:

1. Warp knitted heat resistant separation fabric for mould covering in the bending of car glass, wherein the warp knitted heat resistant separation fabric comprises at least two sets of warp yarns, wherein a first set of warp yarns positioned over the width of the fabric forms pillar stitches; and wherein a second set of warp yarns positioned over the width of the fabric shows in its repeat in the fabric an underlap under at least two pillars formed by the first set of warp yarns.

2. Warp knitted heat resistant separation fabric as in claim 1, wherein said fabric does not contain tuck warp yarns.

3. Warp knitted heat resistant separation fabric as in claim 1, wherein said pillar stitch is an open pillar stitch.

4. Warp knitted heat resistant separation fabric as in claim 1, wherein said second set of warp yarns comprises in its repeat an arrangement of two consecutive stitches that are knitted in consecutive courses and in wales that are at least two wales away from each other.

5. Warp knitted heat resistant separation fabric as in claim 1, wherein said underlap of said second set of warp yarns is created by an inlay, wherein in the inlay, the yarns of the second set of warp yarns not building stitches but are laid as an underlap in between overlaps and the underlaps of other yarns that are building stitches.

6. Warp knitted heat resistant separation fabric as claim 1, wherein the number of courses per centimeter is higher than three.

7. Warp knitted heat resistant separation fabric as in claim 1, wherein the number of wales per centimeter is higher than three.

8. Warp knitted heat resistant separation fabric as in claim 1, wherein said first set of warp yarns and/or said second set of warp yarns comprise stainless steel fibers.

9. Warp knitted heat resistant fabric as in claim 1, wherein said first set of warp yarns and/or said second set of warp yarns comprise glass fibers.

10. Warp knitted heat resistant fabric as in claim 1, wherein said first set of warp yarns and/or said second set of warp yarns comprise PBO-fibers.

11. Method for the production of a warp knitted heat resistant separation fabric for mould covering in the bending of car glass, wherein the warp knitted heat resistant separation fabric for mould covering in the bending of car glass comprises at least two sets of warp yarns, wherein a first set of warp yarns positioned over the width of the fabric forms pillar stitches, and wherein a second set of warp yarns positioned over the width of the fabric shows in its repeat in the fabric an underlap under at least two pillars formed by the first set of warp yarns, wherein the method comprises the step of knitting the warp knitted heat resistant fabric on a warp knitting machine or on a raschel machine or on a warp knitting crochet machine.

12. Method for the production of a warp knitted heat resistant fabric as in claim 11, wherein the gauge of said machine is finer than or equal to 8 needles per inch.

13. Method of using a warp knitted heat resistant separation fabric in glass manufacturing, wherein the warp knitted heat resistant separation fabric for mould covering in the bending of car glass comprises at least two sets of warp yarns, wherein a first set of warp yarns positioned over the width of the fabric forms pillar stitches, and wherein a second set of warp yarns positioned over the width of the fabric shows in its repeat in the fabric an underlap under at least two pillars formed by the first set of warp yarns, wherein the method comprises the step of covering a mold with said heat resistant separation fabric.

14. Method as in claim 13, wherein the warp knitted heat resistant separation fabric comprises a technical face, wherein the method comprises the step of contacting the mold covered with said heat resistant separation fabric with glass, wherein the technical face of the warp knitted heat separation fabric is in contact with the glass.

* * * * *